US012053681B2

(12) United States Patent
Pacha et al.

(10) Patent No.: US 12,053,681 B2
(45) Date of Patent: Aug. 6, 2024

(54) GOLF BAGS AND METHODS TO MANUFACTURE GOLF BAGS

(71) Applicant: PARSONS XTREME GOLF, LLC, Scottsdale, AZ (US)

(72) Inventors: Duane E. Pacha, Chandler, AZ (US); Aaron M. Marohl, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 165 days.

(21) Appl. No.: 17/377,728

(22) Filed: Jul. 16, 2021

(65) Prior Publication Data

US 2022/0023727 A1 Jan. 27, 2022

Related U.S. Application Data

(60) Provisional application No. 63/055,281, filed on Jul. 22, 2020.

(51) Int. Cl.
*A63B 55/57* (2015.01)

(52) U.S. Cl.
CPC ..... *A63B 55/57* (2015.10); *A63B 2209/08* (2013.01)

(58) Field of Classification Search
CPC ..... A63B 55/57; A63B 2209/08
USPC ..... 206/315.7
See application file for complete search history.

(56) References Cited

U.S. PATENT DOCUMENTS 6,224,537 B1 5/2001 Shin
7,303,070 B1 12/2007 Hong
7,549,534 B1 6/2009 Parpart
7,568,566 B2 8/2009 D'Ambrosio
9,302,162 B1 * 4/2016 Foxman ..... A63B 55/00
2004/0026279 A1 * 2/2004 Miller ..... A63B 55/40 206/315.3
2008/0023356 A1 * 1/2008 Manaster ..... A63B 55/00 206/315.3
2008/0047639 A1 2/2008 Fox
(Continued)

FOREIGN PATENT DOCUMENTS

CN 211195640 U 8/2020

OTHER PUBLICATIONS

Gatorfeet: https://www.amazon.com/Golf-Bag-Stand-Replacement-Feet/dp/B00ITV8PYK/ref=sr_1_31?crid=JYLRBEGOZX4R&keywords=magnetic+golf+replacement+feet&qid=1701378792&s=sporting-goods&sprefix=magnetic+golf+replacement+feet%2Csporting%2C172&sr=1-31 (Year: 2014).*

*Primary Examiner* — Don M Anderson
*Assistant Examiner* — Jessica Kavini Tamil

(57) ABSTRACT

Examples of golf bags and methods to manufacture stand golf bags are generally described herein. A golf bag may include a body portion with a first leg and a second leg. Each of the first leg and the second leg may be pivotally coupled to the body portion and moveable between a retracted position against the body portion and a deployed position away from the body portion. The first leg may include a first foot having a first retention portion configured to aid in retaining the first leg in the retracted position through magnetic attraction between the first retention portion and the body portion. The second leg may include a second foot having a second retention portion configured to aid in retaining the second leg in the retracted position through magnetic attraction between the second retention portion and the body portion. Other examples may be described and claimed.

20 Claims, 9 Drawing Sheets

(56) References Cited

U.S. PATENT DOCUMENTS

| | | | | |
|---|---|---|---|---|
| 2009/0057180 | A1* | 3/2009 | Smeltzer | A63B 55/00 206/315.7 |
| 2009/0212174 | A1* | 8/2009 | Pratt | A63B 55/57 248/97 |
| 2012/0048754 | A1 | 3/2012 | Niedermeier et al. | |
| 2016/0074722 | A1 | 3/2016 | Rogers et al. | |

* cited by examiner

GOLF BAGS AND METHODS TO MANUFACTURE GOLF BAGS

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf bags and methods to manufacture golf bags.

CROSS REFERENCE

This application claims the benefit of U.S. Provisional Patent Application No. 63/055,281, filed on Jul. 22, 2020, which is hereby incorporated by reference in its entirety.

BACKGROUND

Golf bags are used to carry golf clubs and accessories. Some golf bags are tube-shaped and hold a set of golf clubs and include one or more pockets for holding golf balls, tees, gloves, rain gear, and other golf related equipment and accessories. Golf bags may include an open top end that is divided into a plurality of slots to allow an individual to organize and sort a plurality of golf clubs. A stand golf bag is a golf club bag that includes a stand. The stand may include a pair of support legs that allow the golf bag to stand upright on the ground so that golf clubs within the golf bag are readily accessible. The support legs may be retractable to make the golf bag easier to carry.

Figure 1:
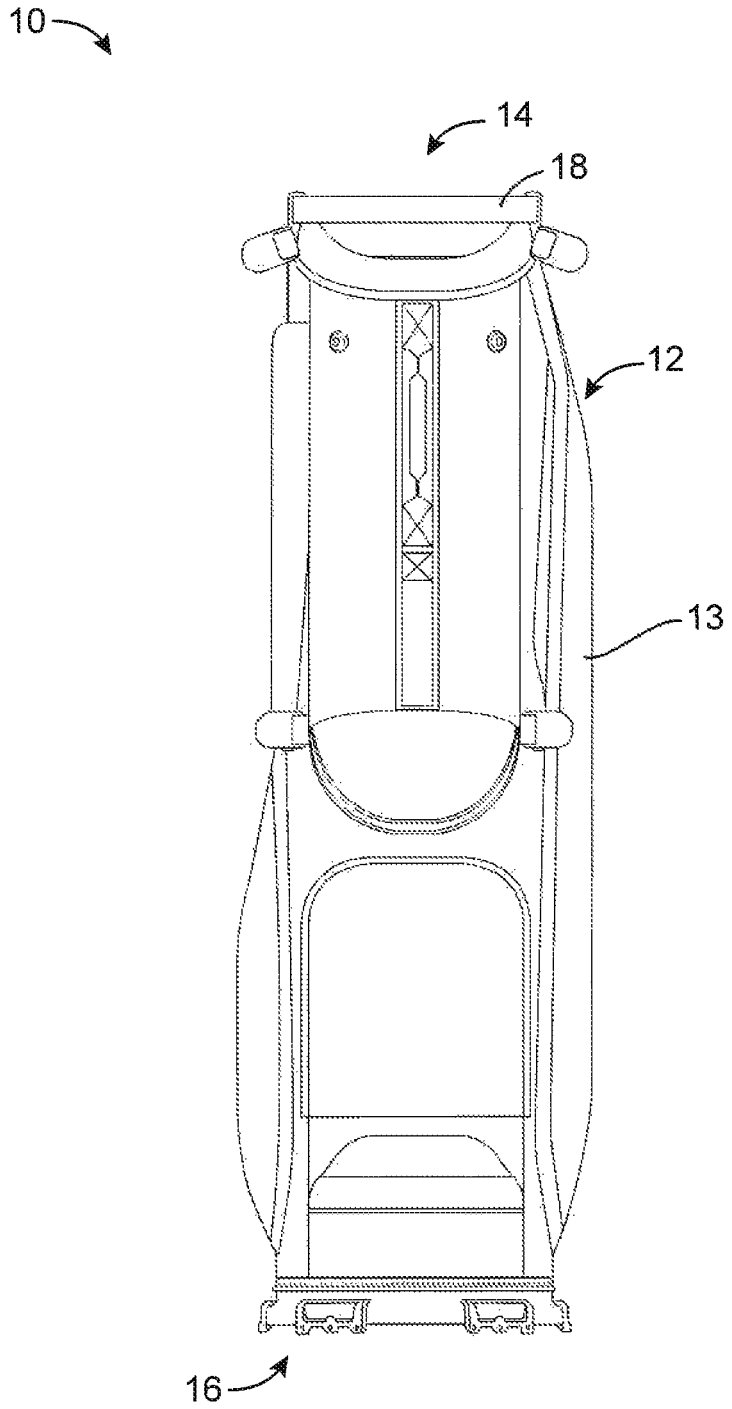
FIG. 1 depicts a front view of a stand golf bag according to an example of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of examples of the present disclosure.

DESCRIPTION

In general, golf club bags and methods to manufacture golf club bags are described herein. The apparatus, methods, and articles of manufacture described herein are not limited in this regard.

In the example of FIGS. 1-4, a stand golf bag 10 may include a body portion 12. The body portion 12 may be a tubular elongated body. The body portion 12 may include an open top portion 14. The body portion 12 may include a bottom portion 16. The body portion 12 may include an exterior surface 13 that extends from the bottom portion 16 to the open top portion 14. The open top portion 14 may include a divider 18 through which one or more golf clubs (not shown) may be received and at least partially stored in the body portion 12 of the stand golf bag 10. The apparatus, methods, and articles of manufacture described herein are not limited in this regard.

The stand golf bag 10 may include a retractable stand assembly 25. The retractable stand assembly 25 may include a first bracket 22 and a second bracket 24 that are pivotally coupled to a collar 20. The collar 20 may be located at or proximate to the open top portion 14 of the body portion 12. The collar 20 may be an integral part of the divider 18 or provided separately. The apparatus, methods, and articles of manufacture described herein are not limited in this regard.

The retractable stand assembly 25 may include a first leg 26 having a first end and a second end opposite the first end, and a second leg 28 having a first end and a second end opposite the first end. The first end of the first leg 26 may be coupled to the first bracket 22 and thereby pivotally coupled to the body portion 12. The first end of the second leg 28 may be coupled to the second bracket 24 and thereby pivotally coupled to the body portion 12. The first and second legs 26 and 28 may be movable between a retracted position against the body portion 12 and a deployed position away from the body portion 12. The apparatus, methods, and articles of manufacture described herein are not limited in this regard.

Figure 2:
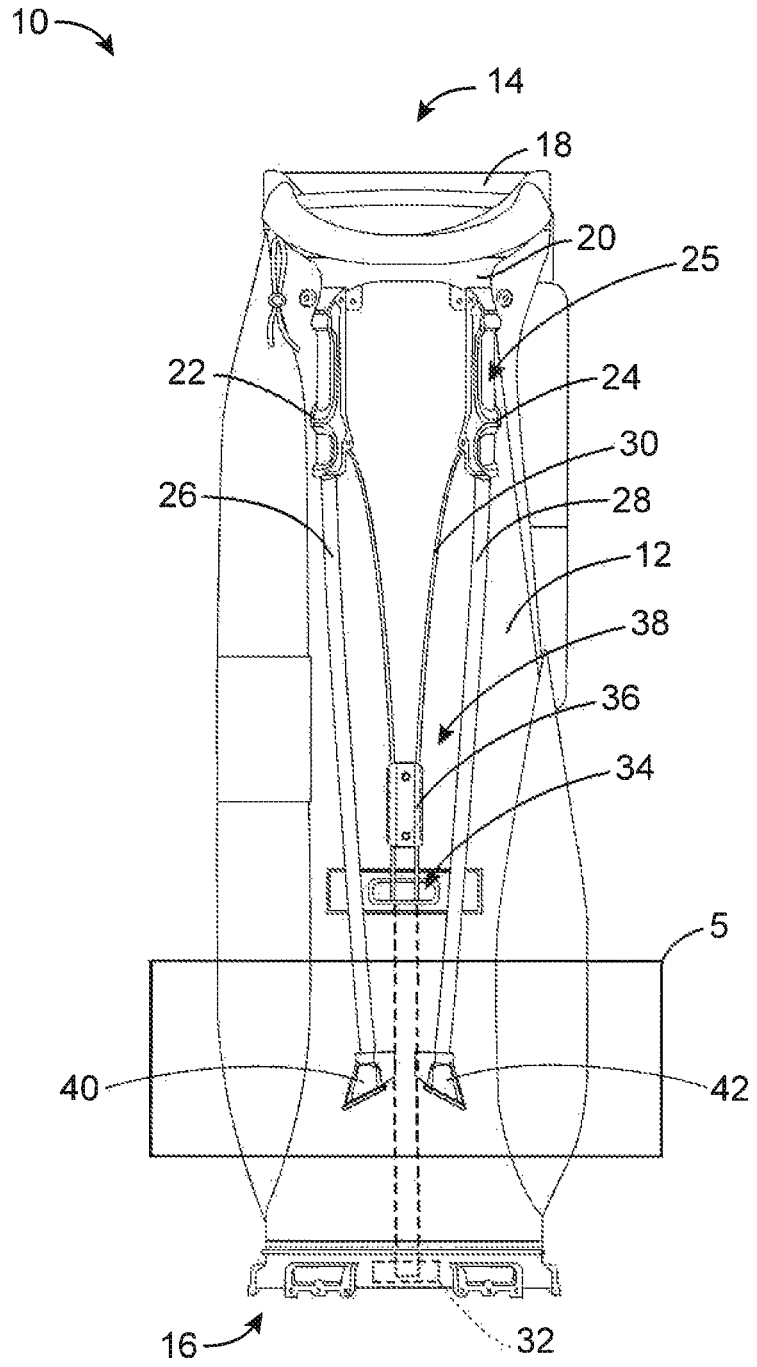
FIG. 2 depicts a rear view of the stand golf bag of FIG. 1.
Figure 3:
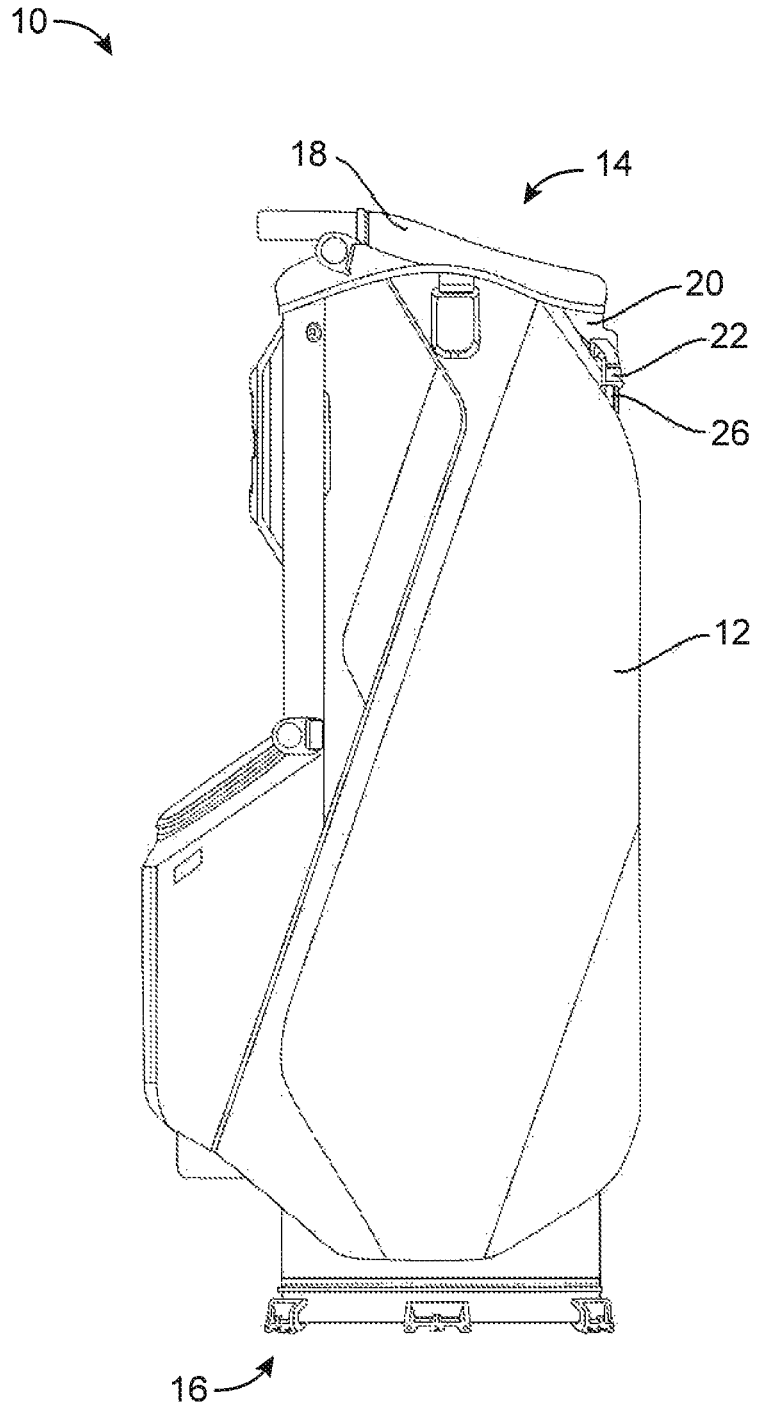
FIG. 3 depicts a left view of the stand golf bag of FIG. 1.
Figure 4:
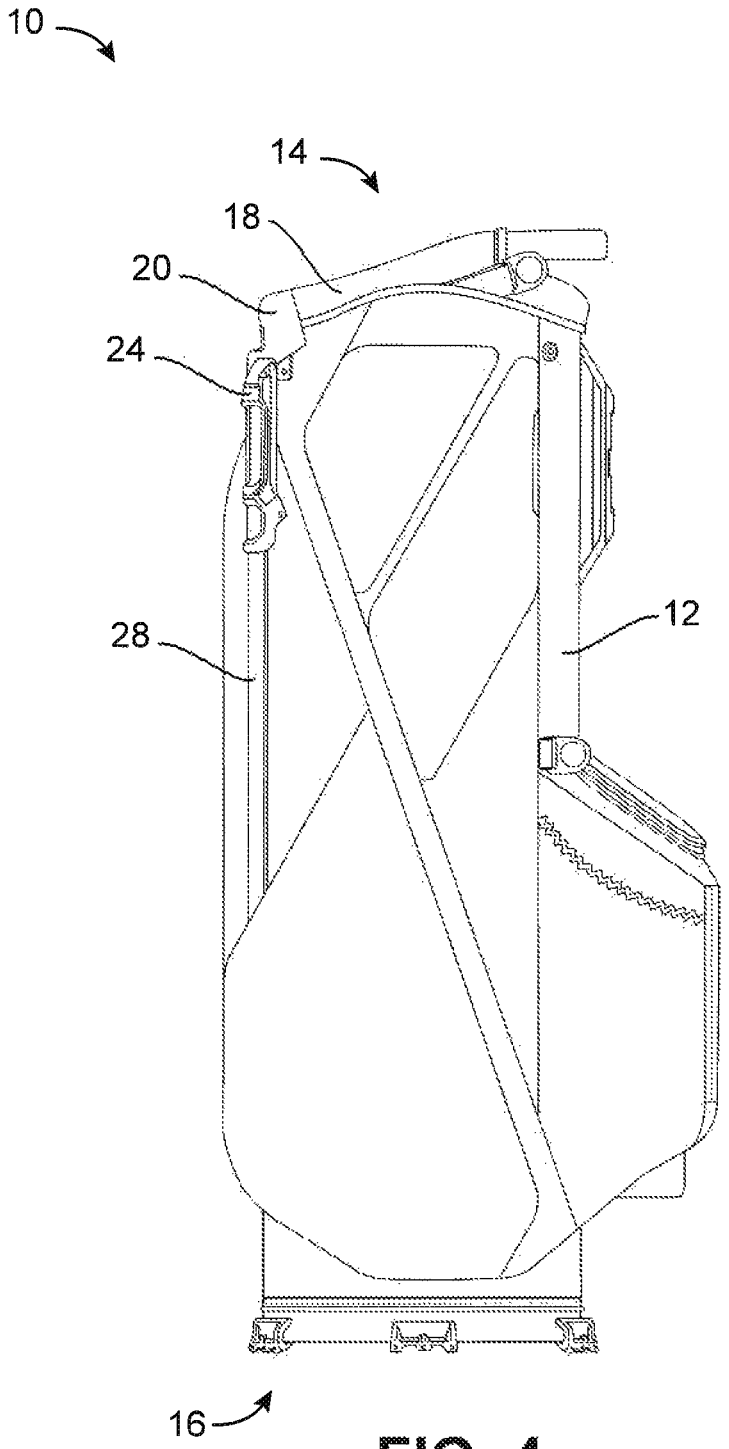
FIG. 4 depicts a right view of the stand golf bag of FIG. 1.

The retractable stand assembly 25 may include a push rod 30. The push rod 30 may be a Y-shaped push rod. The retractable stand assembly 25 may include a third bracket 32 located in the bottom portion 16. The push rod 30 may be connected to the first and second brackets 22 and 24 and be connected to the bottom portion 16 by way of the third bracket 32. Alternatively, the push rod 30 may be directly connected to the first and second legs 26 and 28 and connected to the bottom portion 16 by way of the third bracket 32. As shown in FIG. 2, a lower portion of the push rod 30 may be located within the body portion 12 and an upper portion of the push rod 30 may be located outside the body portion 12. The upper portion of the push rod 30 may extend through an opening 34 formed in the body portion 12 and extend upward to the first and second brackets 22 and 24. The push rod 30 may be a unitary or multi-piece structure made from a resilient metal material such as, but not limited to, a steel rod. The apparatus, methods, and articles of manufacture described herein are not limited in this regard.

The retractable stand assembly 25 may include a push rod retainer 36. The push rod retainer 36 may maintain the Y shape of the pushrod and retain the spring properties of the push rod 30 during deployment and retraction of the first leg 26 and the second leg 28. During deployment and retraction of the first and second legs 26 and 28, the push rod 30. When deploying the first and second legs 26 and 28, the push rod retainer 36 may prevent the push rod 30 from bowing outward from the body portion 12 (i.e., prevent expansion or excessive expansion of the Y shape of the push rod 30) and thereby aid in transferring force from the push rod 30 to the first and second brackets 22 and 24 to promote deployment of the first and second legs 26 and 28. Further, by maintaining the Y shape of the push rod 30 during deployment, the push rod retainer 36 assists in spring loading the push rod 30 for retraction of the first and second legs 26 and 28. When the golf bag 10 is picked up and carried, pressure applied to the push rod 30 by the ground surface is relieved, thereby allowing the spring force of the push rod 30 (i.e., spring loaded during deployment) to slide the push rod 30 downward and the first and second legs 26 and 28 to retract inward toward the body. The apparatus, methods, and articles of manufacture described herein are not limited in this regard.

When the stand golf bag 10 is carried or set against the ground in an upright position, the first and second legs 26 and 28 may bias toward a retracted position with the legs drawn inward against or proximate to the body portion 12. In some instances, an individual may set the stand golf bag 10 against the ground with a rearward tilt, thereby causing the push rod 30 to be pressed upward due to interaction with a ground surface and thereby transfer an upward force against the first and second brackets 22 and 24, which causes the first and second legs 26 and 28 to deploy in an outward direction about the pivot points established between the first and second brackets 22 and 24 and the collar 20. The apparatus, methods, and articles of manufacture described herein are not limited in this regard.

In one example, the retractable stand assembly 25 may include a first foot 40 that may be removably attached to the second end of the first leg 26, and a second foot 40 that may be removably attached to the second end of the second leg 28. Each of the first and second feet 40 and 42 may include a high friction sole, such as a rubber sole. In one example, shown in FIG. 8, the first and second feet 40 and 42 may include ribbed rubber soles to increase friction between the soles and the ground. In another example, the soles of first and second feet 40 and 42 may include any surface pattern to increase friction. In yet another example, the soles 43 of the first and second feet 40 and 42 may include spikes to penetrate the ground to secure the first leg 26 and the second leg 28 in the deployed position. In yet another example, the first foot 40 and the second foot 42 may be made from a different material than the materials of the first leg 26 and the second leg 28. The first foot 40 and the second foot 42 may be constructed from an elastic polymer material (e.g., rubber) to provide enhanced friction, stability, and/or dampening when the first leg 26 and the second leg 28 are deployed. When the first and second legs 26 and 28 are deployed, the first and second feet 40 and 42 may come to rest against the ground and aid in supporting the stand golf bag 10 in a tilted upright position in which the stand golf bag 10 is less prone to falling over compared to when the stand golf bag 10 is stood upright with the first and second legs 26 and 28 in a retracted position. The apparatus, methods, and articles of manufacture described herein are not limited in this regard.

To prevent the first and second legs 26 and 28 from drooping, sagging, or inadvertently deploying while the stand golf bag 10 is being carried or stood upright against the ground, the retractable stand assembly 25 may include a leg retention assembly 60 configured to retain the legs against the body portion 12. The leg retention assembly 60 may not be visible to an individual using the stand golf bag 10. The leg retention assembly 60 may include one or more magnets configured to facilitate contactless retention of the first and second legs 26 and 28 in a retracted position. The leg retention assembly 60 may not require manual actuation each time the golf bag is lifted from the ground and carried. For example, the leg retention assembly 60 may be free of any leg straps or clips that would require manual operation by an individual using the stand golf bag 10. The leg retention assembly 60 may be a hands-free leg retention system that may operate without intervention. The apparatus, methods, and articles of manufacture described herein are not limited in this regard.

Figure 5:
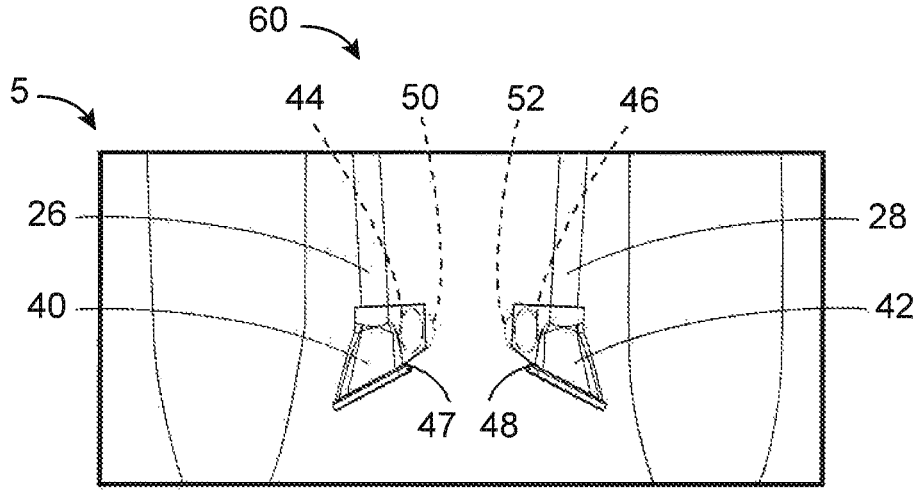
FIG. 5 depicts an enlarged view of area 5 of the stand golf bag of FIG. 2 and illustrates an example of a leg retention assembly of the stand golf bag of FIGS. 1-4.

In the example of FIG. 5, the first foot 40 may include a first retention portion 44 that magnetically couples to the body portion 12. In one example, the first retention portion 44 may be a magnetic retention portion that magnetically attracts a metal portion within or outside the body portion 12 to retain the first leg 26 in a retracted position. In another example, the first retention portion 44 may be a magnetic retention portion that magnetically attracts and/or is magnetically attracted to another magnet within or outside the body portion 12 to retain the first leg 26 in a retracted position. In yet another example, the first retention portion 44 may be a metal portion that is magnetically attracted to a magnet located within or outside the body portion 12 to retain the first leg 26 in a retracted position. The first retention portion 44 may be disposed at any location inside or outside of the first foot 40. In one example, the first retention portion 44 may be positioned at or proximate to a first heel portion 47 of the first foot 40. In another example, the first retention portion 44 may be positioned at or proximate to a side portion of the first foot 40. In yet another example, the first retention portion 44 may be located at the second end of the first leg 26. The apparatus, methods, and articles of manufacture described herein are not limited in this regard.

In the example of FIG. 5, the second leg 28 may include a second foot 42. The second foot 42 may include a second retention portion 46 that magnetically couples to the body portion 12. In one example, the second retention portion 46 may be a magnetic retention portion that magnetically attracts a metal portion within or outside the body portion 12 to retain the second leg 28 in a retracted position. In another example, the second retention portion 46 may be a magnetic retention portion that magnetically attracts and/or is magnetically attracted to another magnet within or outside the body portion 12 to retain the second leg 28 in a retracted position. In yet another example, the second retention portion 46 may be a metal portion that is magnetically attracted to a magnet located within or outside the body portion 12 to retain the second leg 28 in a retracted position. The second retention portion 46 may be disposed at any location inside or outside of the second foot 42. In one example, the second retention portion 46 may be positioned at or proximate to a second heel portion 48 of the second foot 42. In another example, he second retention portion 46 may be positioned at or proximate to a side portion of the second foot 42. In yet another example, the second retention portion 46 may be located at the second end of the second leg 28. The apparatus, methods, and articles of manufacture described herein are not limited in this regard.

Figure 8:
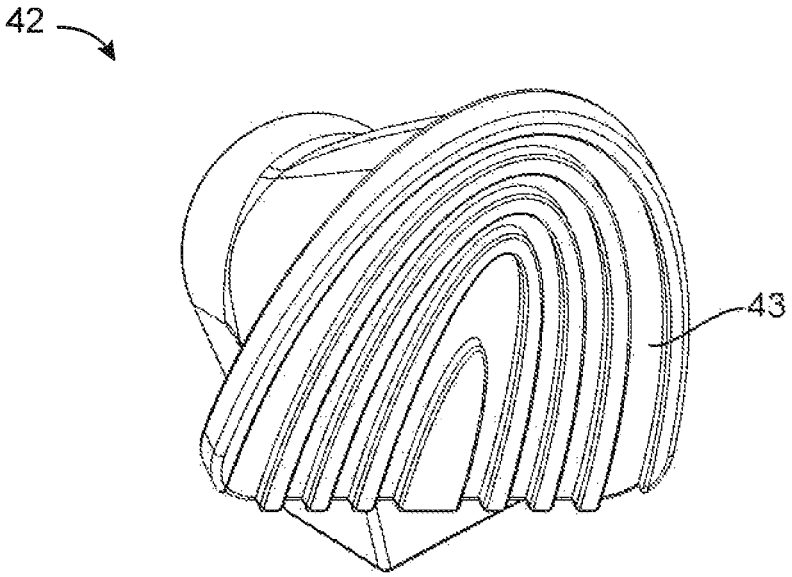
FIG. 8 shows a bottom perspective view of a foot of the stand golf bag of FIGS. 1-4.
Figure 9:
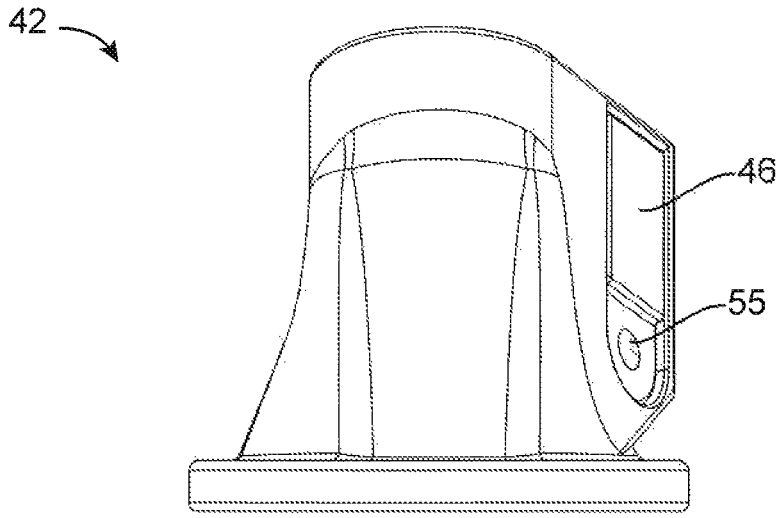
FIG. 9 shows a right side view of the foot of FIG. 8.
Figure 10:
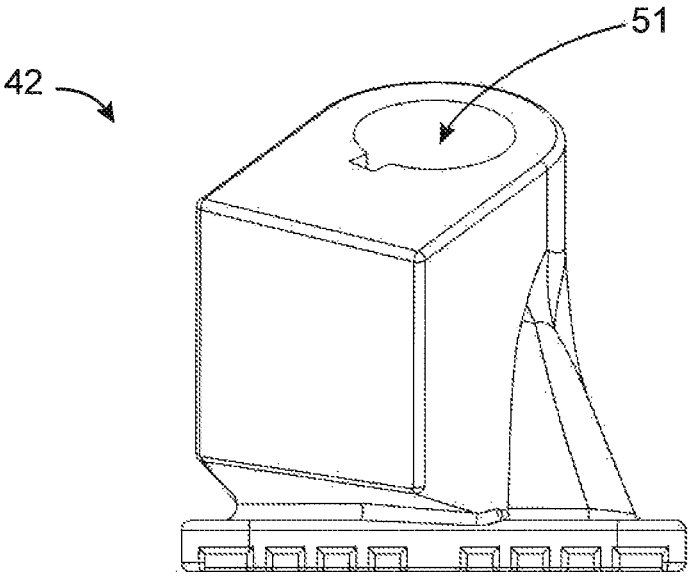
FIG. 10 shows a left side view of the foot of FIG. 8.
Figure 11:
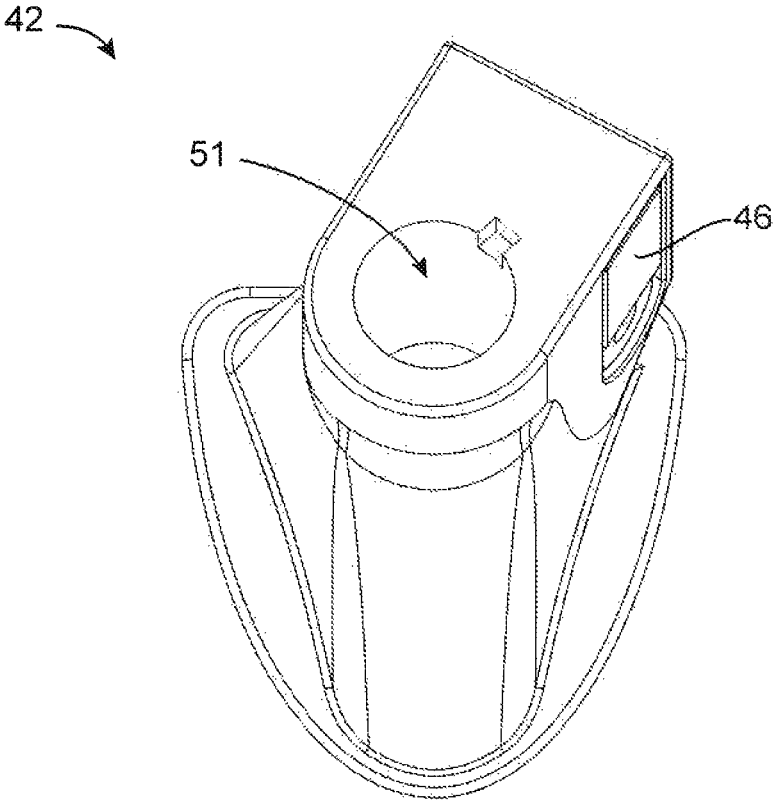
FIG. 11 shows a top perspective view of the foot of FIG. 8.
Figure 12:
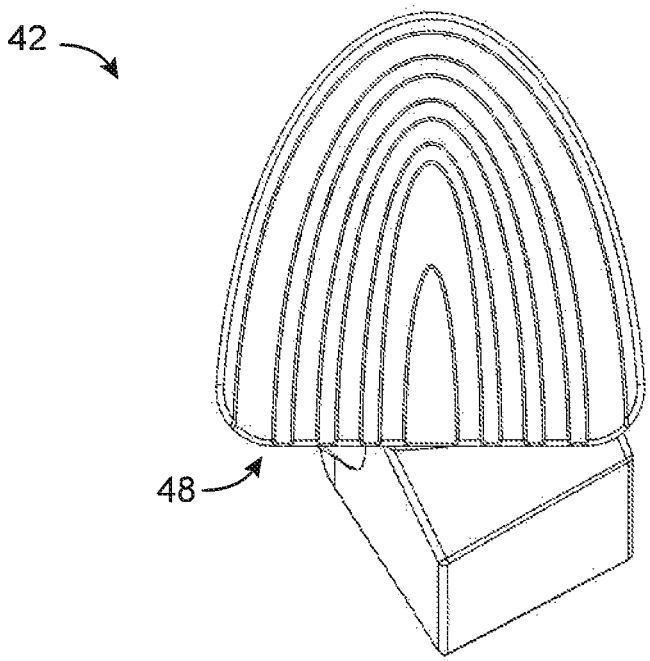
FIG. 12 shows a bottom view of the foot of FIG. 8.
Figure 13:
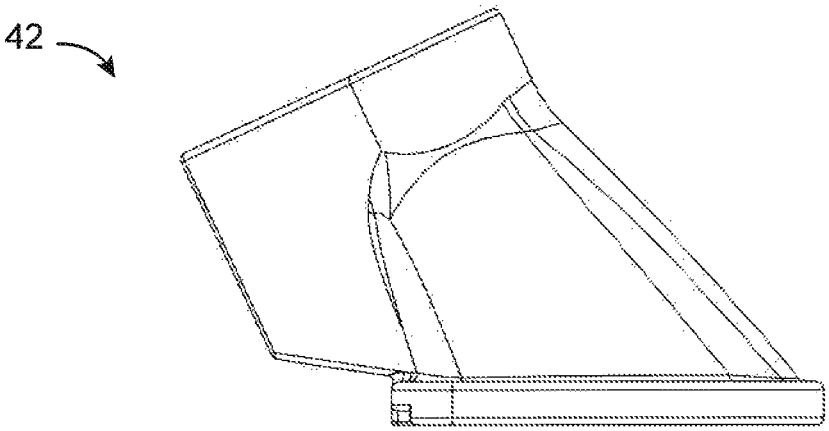
FIG. 13 shows a front view of the foot of FIG. 8.
Figure 14:
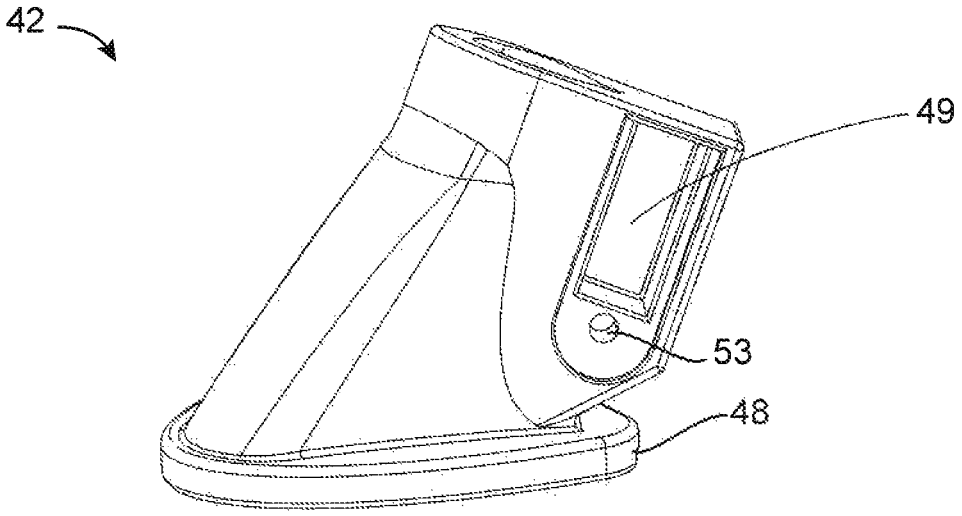
FIG. 14 shows a rear view of the foot of FIG. 8 with a retention portion removed to expose a cavity in a side portion of the foot.
Figure 15:
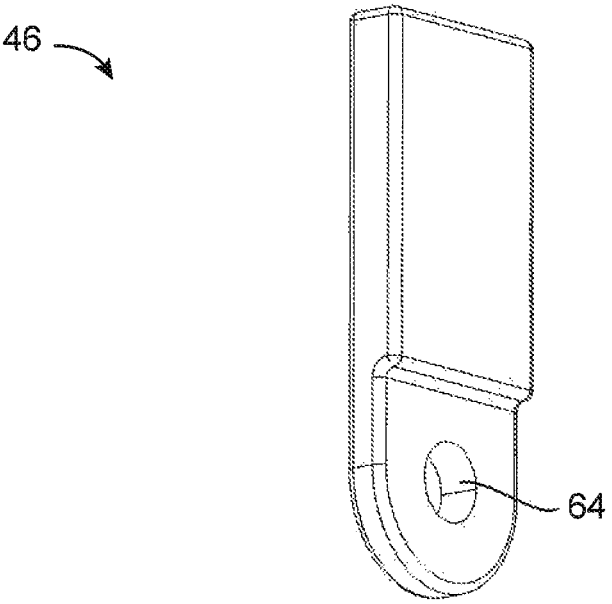
FIG. 15 shows a retention portion of the foot of FIGS. 8-14.

An example second foot 42 is shown in FIGS. 8-14. The first foot 40 may be identical or similar in many respects to the second foot 42. Accordingly, any properties and/or characteristics of the second foot 42 as described herein may equally apply to the first foot 40. The second foot 42 may include an opening 51 to receive the second end of the second leg 28. As shown in FIG. 13, for example, the second foot 42 may be shaped to maximize contact between the sole 43 of the second foot 42 and the ground when the second leg 28 is in the deployed position. Accordingly, as shown in FIG. 13, the sole 43 may have a certain angle relative to a center axis of the opening 51 to maximize contact between the sole 43 and the ground (i.e., sole 43 laying flat or substantially flat on the ground) when the second leg 28 is in the deployed position. As described herein, the first foot 40 and the second foot 42 may be made from an elastic polymer material. Accordingly, the opening 51 may have a smaller inner diameter than an outer diameter of the first leg 26 and the second leg 28 to elastically receive the corresponding second end of the first leg 26 or the second end of the second leg 28 (i.e., the opening 51 is elastically expanded to receive the first leg 26 or the second leg 28) to maintain the first foot 40 and the second foot 42 elastically attached to the first leg 26 and the second leg 28. The second foot 42 may include a high friction sole 43, which may include one or more structures, such as ribs as shown in FIG. 8, to enhance friction between the sole 43 and the ground. The second foot 42 may have a cavity 49 configured to receive the second retention portion 46. An example second retention portion 46 is shown in FIG. 15. The second retention portion 46 may be a magnetic insert that is mounted in the cavity 49 in the second foot 42. Alternately, the second retention portion 46 may be a metal portion that is mounted in the cavity 49 in the second foot 42. In one example, the second retention portion 46 may have a thru-hole 64 that when aligned with a threaded hole 53 in the cavity 49, cooperatively receive a fastener 55 to securely mount the second retention portion 46 in the cavity 49. The second retention portion 46 may be removably connected to the second foot 42 to allow the second retention portion 46 to be replaced with a retention portion having a stronger or weaker magnet depending on, for example, preference of an individual or age or condition of the retractable stand assembly 25. In another example, however, the retention portion 46 may be connected to the second foot 42 with an adhesive or other permanent or semi-permanent attachment methods. The second retention portion 46 may be mounted flush or recessed into the cavity 49, as shown in FIG. 11. The cavity 49 may be located at or proximate to the second heel portion 48 of the second foot 42. The cavity 49 may be disposed in a side portion of the second foot 42 to reduce a distance between the second retention portion 46 and the exterior surface 13 of the body portion 12 when the second leg 28 is in a retracted position. Reducing the distance between the second retention portion 46 and the exterior surface 13 of the body portion 12 may strengthen the magnetic attraction between the second retention portion 46 and a corresponding retention portion (e.g., a magnet or metal member) on the body portion 12. The apparatus, methods, and articles of manufacture described herein are not limited in this regard.

As described herein, the first foot 40 may be removably attached to the first leg 26, and the second foot 42 may be removably attached to the second leg 28. In one example, the first foot 40 and the second foot 42 may be removed from the first leg 26 and the second leg 28, respectively, and exchanged with another first foot 40 and another second foot 42. Accordingly, an individual may exchange the first and second feet 40 and 42. In one example, an individual may replace the first foot 40 and the second foot 42 due to wear and tear or damage (e.g., torn or cracked feet). In another example, an individual may replace the first foot 40 and the second foot 42 with another first foot 40 and second foot 42 having different sole frictional properties (e.g., replace feet with other feet having spikes). In another example, an individual may replace the first foot 40 and the second foot 42 for cosmetic or visual reasons (e.g., to change the color of the feet). In another example, an individual may replace the first foot 40 and the second foot 42 with larger feet to provide additional stability for the golf bag when the legs 26 and 28 are in the deployed position. In yet another example, an individual may replace the first foot 40 and the second foot 42 with feet made from different materials than the original feet, for example, to change the functional properties of the feet and/or to increase longevity of the feet. As also described herein, the retention portions 46 may be magnets and replaceable. Accordingly, an individual may replace the retention portions 46 with stronger magnets to increase the magnetic retention force of the first leg 26 and the second leg 28 against the body portion 12 and/or to prevent or reduce unintended deployment of the first leg 26 and the second leg 28. The replacement of the retention portions 46 with retention portions 46 having stronger magnets may be necessary with long term and repeated deployment and retraction of the first leg 26 and the second leg 28 due to possible reduction in the magnetic forces of the retention portions 46. Additionally, replacement of the retention portions 46 may be necessary due to wear and tear and/or damage. Thus, with the retractable stand assembly 25 having a replaceable first foot 40, a replaceable second foot 42, and replaceable retention portions 46 as described herein, the retractable stand assembly may be customized, modified, and/or repaired by an individual. The apparatus, methods, and articles of manufacture described herein are not limited in this regard.

As described herein, the first retention portion 44 may couple to a corresponding magnetic and/or metal portion on the body portion 12 to retain the first leg 26 in a retracted position, and the second retention portion 46 may couple to a corresponding magnetic and/or metal portion on the body portion 12 to retain the second leg 28 in a retracted position. In one example, the body portion 12 may include a third retention portion 50, which may be a magnet or metal portion, and which may be disposed inside or outside the body portion 12 of the stand golf bag 10 and positioned to align or substantially align with the first retention portion 44 when the first leg 26 is in the retracted position. Likewise, in another example, the body portion 12 may include a fourth retention portion 52, which may be a magnet or metal portion, and which may be disposed inside or outside the body portion 12 of the stand golf bag 10 and positioned to align or substantially align with the second retention portion 46 when the second leg 28 is in the retracted position. The third and fourth retention portions 50 and 52 may be oriented to establish a magnetic attraction with the first and second retention portions 44 and 46, respectively. As a result, the magnetic attraction between the first and third retention portions 44 and 50, and the magnetic attraction between the second and fourth retention portions 46 and 52, may aid in retaining the first and second legs 26 and 28 in the retracted position and also serve to prevent drooping, sagging, or inadvertent deployment of the first and second legs 26 and 28 while the stand golf bag 10 is being carried or stood upright against the ground. The apparatus, methods, and articles of manufacture described herein are not limited in this regard.

Figure 6:
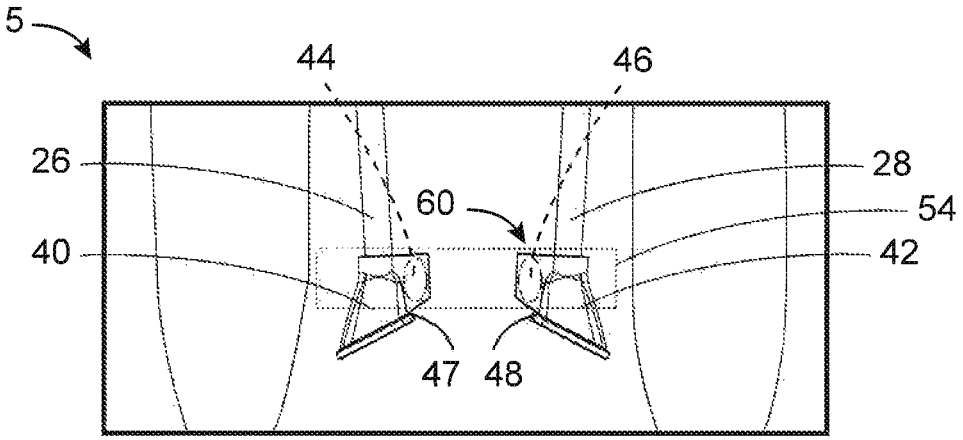
FIG. 6 depicts an enlarged view of area 5 of the stand golf bag of FIG. 2 and illustrates another example of a leg retention assembly of the stand golf bag of FIGS. 1-4.

As described herein, the first retention portion 44 may couple to a corresponding magnetic and/or metal portion on the body portion 12 to retain the first leg 26 in a retracted position, and the second retention portion 46 may couple to a corresponding magnetic and/or metal portion on the body portion 12 to retain the second leg 28 in a retracted position. In the example of FIG. 6, the metal portions on the body portion 12 that are attracted by the first retention portion 44 and the second retention portion 46 may be define by a metal portion 54, such as a metal plate, which may be disposed inside or outside the body portion 12 of the stand golf bag 10 and positioned to align or substantially align with the first and second retention portions 44 and 46 to establish a magnetic attraction therebetween when the first and second legs 26 and 28 are in the retracted position. In one example, the metal portion 54 may be a single piece and have a rectangular shape and may extend lengthwise in a lateral direction across the body portion 12 of the stand golf bag 10 as shown in FIG. 6. In another example, the metal portion 54 may be provided as multiple pieces. In another example, the metal portion 54 may instead be embodied as a single magnet oriented to establish a magnetic attraction with the first and second retention portions 44 and 46. In yet another example, the first and second retention portions 44 and 46 may instead be embodied as metal pieces, while the metal portion 54 may be a single magnetic piece or multiple magnetic pieces. The apparatus, methods, and articles of manufacture described herein are not limited in this regard.

Figure 7:
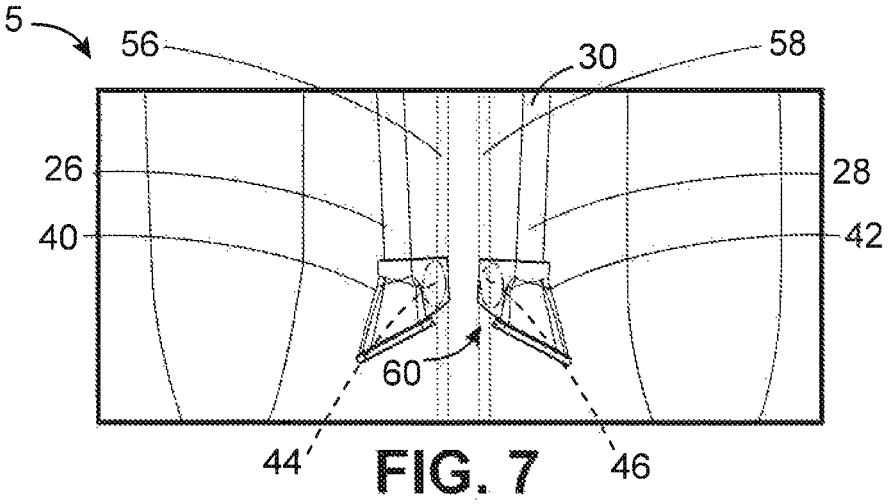
FIG. 7 depicts an enlarged view of area 5 of the stand golf bag of FIG. 2 and illustrates yet another example of a leg retention assembly of the stand golf bag of FIGS. 1-4.

In the example of FIG. 7, the push rod 30 may be configured to align or substantially align with the first and second retention portions 44 and 46 to establish a magnetic attraction therebetween when the first and second legs 26 and 28 are in the retracted position. The push rod 30 may have a two-beam construction characterized by a first beam 56 and a second beam 58. The first beam 56 may connect to the first bracket 22 and align or substantially align with the first retention portion 44. The second beam 58 may connect to the second bracket 24 and align or substantially align with the second retention portion 46. The first and second beams 56 and 58 may connect with each other to form the end of the push rod 30 that is retained by the third bracket 32. The first beam 56 and the second beam 58 diverge above the push rod retainer 36 and connect to the first bracket 22 and the second bracket 24, respectively, to define a Y-shaped push rod 30 as defined herein. In another example (not shown), the first and second beams 56 and 58 of the push rod 30 may be provided as separate components. The apparatus, methods, and articles of manufacture described herein are not limited in this regard.

With respect to the example leg retention assemblies of FIGS. 5-7, the strength of the magnetic attractions between the retention portions may be varied based on how much leg retention is preferred. Generally, it may be preferable to select a retention level that does not overly hinder an individual from deploying the first and second legs 26 and 28. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled," and any variation thereof, refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf bag comprising:

a body portion configured to receive a plurality of golf clubs;

a first leg pivotally coupled to the body portion and moveable between a retracted position against the body portion and a deployed position away from the body portion, the first leg comprising a first foot including a different material than a material of the first leg, the first foot having a first cavity located at or proximate a first heel portion of the first foot and a first retention portion mounted in the first cavity and configured to aid in retaining the first leg in the retracted position through magnetic attraction between the first retention portion and the body portion; and a second leg pivotally coupled to the body portion and moveable between a retracted position against the body portion and a deployed position away from the body portion, the second leg comprising a second foot including a different material than a material of the second leg, the second foot having a second cavity located at or proximate a second heel portion of the second foot and a second retention portion mounted in the second cavity and configured to aid in retaining the second leg in the retracted position through magnetic attraction between the second retention portion and the body portion, wherein the first foot includes a first opening configured to receive the first leg, wherein the second foot includes a second opening configured to receive the second leg, wherein the first opening does not communicate with the first cavity, and wherein the second opening does not communicate with the second cavity.

2. A golf bag as defined in claim 1, further comprising a third retention portion located inside or outside of the body portion, wherein the first retention portion and the third retention portion are configured to magnetically attract to aid in retaining the first leg in the retracted position.

3. A golf bag as defined in claim 1, further comprising a fourth retention portion located inside or outside of the body portion, wherein the second retention portion and the fourth retention portion are configured to magnetically attract to aid in retaining the second leg in the retracted position.

4. A golf bag as defined in claim 1, further comprising a third retention portion located inside or outside of the body portion, wherein the first retention portion and the third retention portion are configured to magnetically attract to aid in retaining the first leg in the retracted position, and wherein the first retention portion comprises a magnet.

5. A golf bag as defined in claim 1, further comprising a fourth retention portion located inside or outside of the body portion, wherein the second retention portion and the fourth retention portion are configured to magnetically attract to aid in retaining the second leg in the retracted position, and wherein the second retention portion comprises a magnet.

6. A golf bag as defined in claim 1, further comprising a third retention portion located inside or outside of the body portion, wherein the first retention portion and the third retention portion are configured to magnetically attract to aid in retaining the first leg in the retracted position, and wherein the first retention portion comprises a metal portion.

7. A golf bag as defined in claim 1, further comprising a fourth retention portion located inside or outside of the body portion, wherein the second retention portion and the fourth retention portion are configured to magnetically attract to aid in retaining the second leg in the retracted position, and wherein the second retention portion comprises a metal portion.

8. A golf bag comprising:

a body portion comprising an open top portion, a bottom portion, and an exterior surface extending between the open top portion and the bottom portion; and a retractable stand assembly attached to the body portion, the retractable stand assembly comprising:

a first bracket pivotally coupled to the body portion;

a second bracket pivotally coupled to the body portion;

a first leg coupled to the first bracket, the first leg comprising a first foot having a first cavity, a first threaded hole in the first cavity, a first retention portion mounted in the first cavity and having a first thru-hole aligned with the first threaded hole, and a first fastener received through the first thru-hole and the first threaded hole to secure the first retention portion in the first cavity, the first foot including a different material than a material of the first leg and being removably attached to the first leg, the first leg being movable between a retracted position against the body portion and a deployed position away from the body portion, and the first retention portion being configured to be magnetically attracted toward the body portion to aid in retaining the first leg in the retracted position; and a second leg coupled to the second bracket, the second leg including a second foot having a second cavity, a second threaded hole in the second cavity, a second retention portion mounted in the second cavity and having a second thru-hole aligned with the second threaded hole, and a second fastener received through the second thru-hole and the second threaded hole to secure the second retention portion in the second cavity, the second foot including a different material than a material of the second leg and being removably attached to the second leg, the second leg being movable between a retracted position against the body portion and a deployed position away from the body portion, and the second retention portion being configured to be magnetically attracted toward the body portion to aid in retaining the second leg in the retracted position, wherein the first foot includes a first opening configured to receive the first leg, wherein the second foot includes a second opening configured to receive the second leg, wherein the first opening does not communicate with the first cavity, and wherein the second opening does not communicate with the second cavity.

9. A golf bag as defined in claim 8, wherein the retractable stand assembly further comprises a push rod extending from the first bracket toward the bottom portion of the body portion, wherein the push rod and the first retention portion are configured to magnetically attract to aid in retaining the first leg in the retracted position, and wherein the push rod comprises a metal material and the first retention portion comprises a magnet.

10. A golf bag as defined in claim 8, wherein the retractable stand assembly further comprises a push rod extending from the second bracket toward the bottom portion of the body portion, wherein the push rod and second retention portion are configured to magnetically attract to aid in retaining the second leg in the retracted position, and wherein the push rod comprises a metal material and the second retention portion comprises a magnet.

11. A golf bag as defined in claim 8 further comprising a collar attached to the body portion at or proximate to the open top portion, wherein the first bracket is pivotally coupled to the collar.

12. A golf bag as defined in claim 8 further comprising a collar attached to the body portion at or proximate to the open top portion, wherein the second bracket is pivotally coupled to the collar.

13. A golf bag as defined in claim 8, wherein the first retention portion comprises a magnetic insert removably attached to the first foot.

14. A golf bag as defined in claim 8, wherein the second retention portion comprises a magnetic insert removably attached to the second foot.

15. A golf bag comprising:

a body portion; and a retractable stand assembly attached to the body portion, the retractable stand assembly comprising:

a first leg having first end and a second end, the first end of the first leg pivotally coupled to the body portion and moveable between a retracted position against the body portion and a deployed position away from the body portion, and the second end of the first leg including a first foot having a first cavity located at a side portion of the first foot;

a second leg having a first end and a second end, the first end of the second leg pivotally coupled to the body portion and moveable between a retracted position against the body portion and a deployed position away from the body portion, and the second end of the second leg including a second foot having a second cavity located at a side portion of the second foot; and a leg retention assembly comprising a first retention portion at or proximate to a second end of the first leg and a second retention portion at or proximate to a second end of the second leg, the first retention portion including a first insert removably coupled to the first cavity with a fastener and configured to be magnetically attracted toward the body portion to aid in retaining the first leg in the retracted position, and the second retention portion including a second insert removably coupled to the second cavity with a fastener and configured to be magnetically attracted toward the body portion to aid in retaining the second leg in the retracted position, wherein the first foot includes a first opening configured to receive the first leg, wherein the second foot includes a second opening configured to receive the second leg, wherein the first opening does not communicate with the first cavity, and wherein the second opening does not communicate with the second cavity.

16. A golf bag as defined in claim 15, the leg retention assembly further comprising a third retention portion located inside or outside of the body portion, wherein the first retention portion and the third retention portion are configured to be magnetically attracted to aid in retaining the first leg in the retracted position.

17. A golf bag as defined in claim 15, the leg retention assembly further comprising a fourth retention portion disposed inside or located outside of the body portion, wherein the second retention portion and the fourth retention portion are configured to be magnetically attracted to aid in retaining the second leg in the retracted position.

18. A golf bag as defined in claim 15, the leg retention assembly further comprising a third retention portion located inside or outside of the body portion, wherein the first retention portion and the third retention portion are configured to be magnetically attracted to aid in retaining the first leg in the retracted position, and wherein the first retention portion comprises a first magnet.

19. A golf bag as defined in claim 15, the leg retention assembly further comprising a fourth retention portion located inside or outside of the body portion, wherein the second retention portion and the fourth retention portion are configured to be magnetically attracted to aid in retaining the second leg in the retracted position, and wherein the second retention portion comprises a second magnet.

20. A golf bag as defined in claim 15, wherein the first retention portion is a first magnet configured to aid in retaining the first leg in the retracted position through magnetic attraction to a metal portion attached to the body portion, and wherein the second retention portion is a second magnet configured to aid in retaining the second leg in the retracted position through magnetic attraction to the metal portion.

* * * * *